US006402211B1

(12) United States Patent
Chapman

(10) Patent No.: US 6,402,211 B1
(45) Date of Patent: Jun. 11, 2002

(54) THUMB PROTECTOR

(76) Inventor: Michael Chapman, 32 Alexandra Road, Kearsley Manchester M26 1HW (GB)

( * ) Notice: Subject to any disclaimer, the term of this patent is extended or adjusted under 35 U.S.C. 154(b) by 0 days.

(21) Appl. No.: 09/802,540

(22) Filed: Mar. 9, 2001

(51) Int. Cl.[7] ..... A41D 13/08
(52) U.S. Cl. ..... 294/25; 2/21
(58) Field of Search ..... 294/25; 2/21; 15/227; 224/218

(56) References Cited

U.S. PATENT DOCUMENTS

| | | | | | |
|---|---|---|---|---|---|
| 942,003 | A | | 11/1909 | Marsh | |
| 1,261,706 | A | * | 4/1918 | Condley et al. | 294/25 |
| 1,755,014 | A | | 4/1930 | Morrison | |
| 2,129,496 | A | | 9/1938 | Hollingsworth | |
| D112,752 | S | | 12/1938 | Douglas et al. | |
| 2,379,624 | A | | 7/1945 | Chisnell | |
| 2,462,208 | A | * | 2/1949 | Meyer | 294/25 |
| 2,717,799 | A | * | 9/1955 | Jones | 294/25 |
| 3,248,112 | A | * | 4/1966 | Metzger | 294/25 X |
| 3,398,951 | A | * | 8/1968 | Disko | 294/25 X |
| 5,640,713 | A | * | 6/1997 | Ping | 2/21 |
| 5,921,488 | A | | 7/1999 | Degrenier | |

* cited by examiner

*Primary Examiner*—Johnny D. Cherry

(57) ABSTRACT

A thumb protector for protecting the thumb of a user from calluses and inflamed skin from repetitive use of computer game controllers. The thumb protector includes a sleeve that is adapted to cover a distal end of the digit of the user. The sleeve has an upper portion and a lower portion; the upper portion is adapted to cover a top of the distal end of the digit and the lower portion is adapted to cover a digital pulp of the digit of the user. A plurality of ridges outwardly extend from the lower portion of the sleeve such that the plurality of ridges are adapted for increasing traction between the sleeve and the game controller when the sleeve is covering the distal end of the digit.

5 Claims, 2 Drawing Sheets

THUMB PROTECTOR

BACKGROUND OF THE INVENTION

1. Field of the Invention

The present invention relates to thumb protectors and more particularly pertains to a new thumb protector for protecting the thumb of a user from calluses and inflamed skin from repetitive use of computer game controllers.

2. Description of the Prior Art

The use of thumb protectors is known in the prior art. More specifically, thumb protectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 942,003; 2,129,496; 1,755,014; U.S. Pat. No. Des. 112,752; U.S. Patent Nos.5,921,488; and 2,379,624.

While these devices fulfill their respective, particular objectives and requirements, the aforementioned patents do not disclose a new thumb protector. The inventive device includes a sleeve that is adapted to cover a distal end of the digit of the user. The sleeve has an upper portion and a lower portion; the upper portion is adapted to cover a top of the distal end of the digit and the lower portion is adapted to cover a digital pulp of the digit of the user. A plurality of ridges outwardly extend from the lower portion of the sleeve such that the plurality of ridges are adapted for increasing traction between the sleeve and the game controller when the sleeve is covering the distal end of the digit.

In these respects, the thumb protector according to the present invention substantially departs from the conventional concepts and designs of the prior art, and in so doing provides an apparatus primarily developed for the purpose of protecting the thumb of a user from calluses and inflamed skin from repetitive use of computer game controllers.

SUMMARY OF THE INVENTION

In view of the foregoing disadvantages inherent in the known types of thumb protectors now present in the prior art, the present invention provides a new thumb protector construction wherein the same can be utilized for protecting the thumb of a user from calluses and inflamed skin from repetitive use of computer game controllers.

The general purpose of the present invention, which will be described subsequently in greater detail, is to provide a new thumb protector apparatus and method which has many of the advantages of the thumb protectors mentioned heretofore and many novel features that result in a new thumb protector which is not anticipated, rendered obvious, suggested, or even implied by any of the prior art thumb protectors, either alone or in any combination thereof.

To attain this, the present invention generally comprises a sleeve that is adapted to cover a distal end of the digit of the user. The sleeve has an upper portion and a lower portion; the upper portion is adapted to cover a top of the distal end of the digit and the lower portion is adapted to cover a digital pulp of the digit of the user. A plurality of ridges outwardly extend from the lower portion of the sleeve such that the plurality of ridges are adapted for increasing traction between the sleeve and the game controller when the sleeve is covering the distal end of the digit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new thumb protector apparatus and method which has many of the advantages of the thumb protectors mentioned heretofore and many novel features that result in a new thumb protector which is not anticipated, rendered obvious, suggested, or even implied by any of the prior art thumb protectors, either alone or in any combination thereof.

It is another object of the present invention to provide a new thumb protector, which may be easily and efficiently manufactured and marketed.

It is a further object of the present invention to provide a new thumb protector which is of a durable and reliable construction.

An even further object of the present invention is to provide a new thumb protector which is susceptible of a low cost of manufacture with regard to both materials and labor, and which accordingly is then susceptible of low prices of sale to the consuming public, thereby making such thumb protector economically available to the buying public.

Still yet another object of the present invention is to provide a new thumb protector which provides in the apparatuses and methods of the prior art some of the advantages thereof, while simultaneously overcoming some of the disadvantages normally associated therewith.

Still another object of the present invention is to provide a new thumb protector for protecting the thumb of a user from calluses and inflamed skin from repetitive use of computer game controllers.

Yet another object of the present invention is to provide a new thumb protector which includes a sleeve that is adapted to cover a distal end of the digit of the user. The sleeve has an upper portion and a lower portion; the upper portion is adapted to cover a top of the distal end of the digit and the lower portion is adapted to cover a digital pulp of the digit of the user. A plurality of ridges outwardly extend from the lower portion of the sleeve such that the plurality of ridges are adapted for increasing traction between the sleeve and the game controller when the sleeve is covering the distal end of the digit.

Still yet another object of the present invention is to provide a new thumb protector that would provide a user with support and protection from rapid button tapping on a game controller. The present invention would also prevent cramps, sore muscles and blisters on the thumb, which they use to top the controller button.

Even still another object of the present invention is to provide a new thumb protector that would provide a user with a snug fit that would act as a brace for the thumb, enabling the thumb to continue playing effortlessly for longer periods of time. The unique colors and designs for the present invention would appeal to children, who would choose one that appeals to them.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
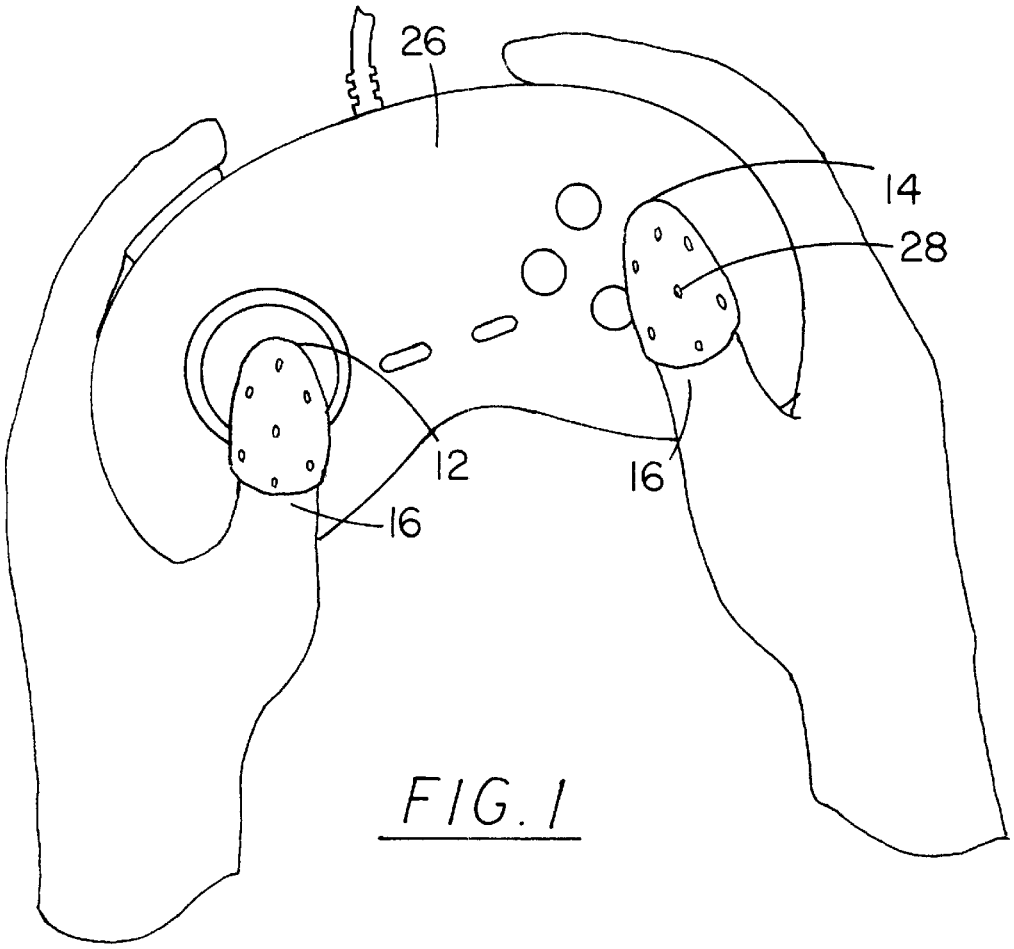
FIG. 1 is a perspective view of a new thumb protector according to the present invention.
Figure 2:
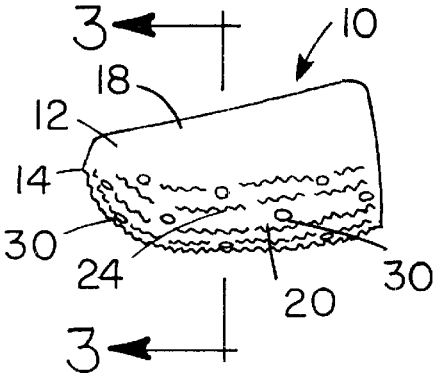
FIG. 2 is a side view of the present invention.
Figure 3:
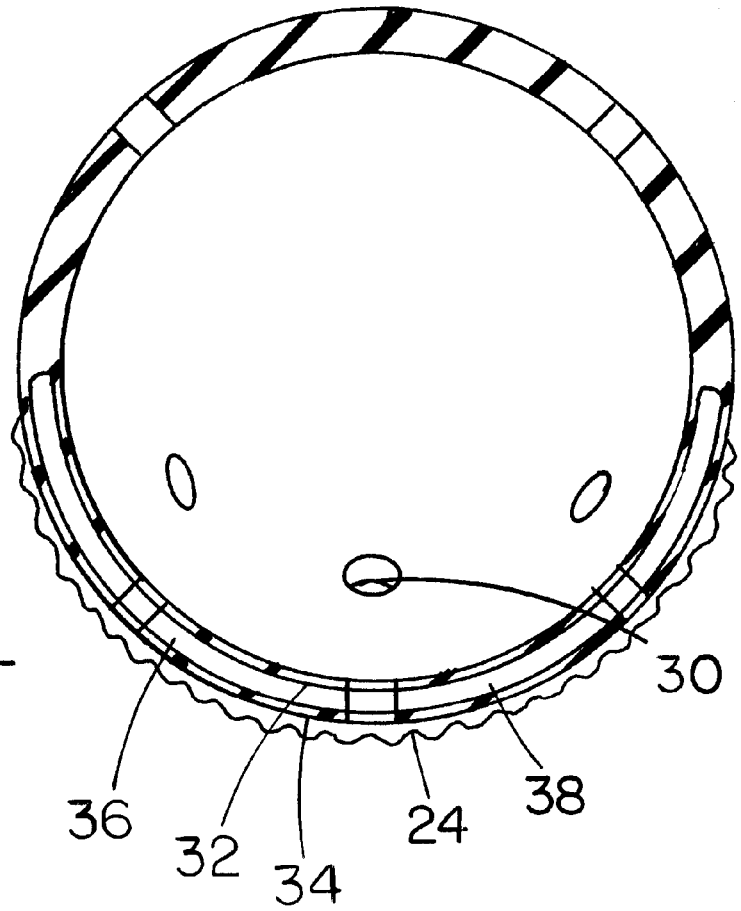
FIG. 3 is a cross-sectional view of the present invention.

With reference now to the drawings, and in particular to FIGS. 1 through 3 thereof, a new thumb protector embodying the principles and concepts of the present invention and generally designated by the reference numeral 10 will be described.

As best illustrated in FIGS. 1 through 3, the thumb protector 10 generally includes a sleeve 12 that is adapted to cover a distal end 14 of the digit 16 of the user. The sleeve 12 has an upper portion 18 and a lower portion 20; the upper portion 18 is adapted to cover a top of the distal end 14 of the digit 16 and the lower portion 20 is adapted to cover a digital pulp of the digit 16 of the user. A plurality of ridges 24 outwardly extend from the lower portion 20 of the sleeve 12 such that the plurality of ridges 24 are adapted for increasing traction between the sleeve 12 and the game controller 26 when the sleeve 12 is covering the distal end 14 of the digit 16.

The upper portion 18 of the sleeve 12 has a plurality of vent holes 28 that extend through the upper portion 18 of the sleeve 12 such thats the vent holes 28 are adapted for permitting perspiration from the digit 16 of the user to evaporate.

The lower portion 20 of the sleeve 12 has a plurality of drying apertures 30 that extend through the lower portion 20 of the sleeve 12 such that the drying apertures 30 are adapted for permitting perspiration from the digit 16 of the user to evaporate. The lower portion 20 of the sleeve 12 has an interior wall 32 and an exterior wall 34. The interior wall 32 and the exterior wall 34 define an interior space 36; the interior space 36 has a padding 38 disposed in the interior space 36 such that the padding 38 is adapted for cushioning the digital pulp of the digit 16 when the sleeve 12 is covering the distal end 14 of the digit 16. The sleeve 12 includes an elastomeric material such that the sleeve 12 is adapted for stretching to fit snuggly on the distal end 14 of the digit 16.

In use, a user would slide the present invention over their thumb. The present invention would then support and protect the thumb of a user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A digit covering for protecting a digit of a user when using a game controller, the digit covering comprising:

a sleeve having a cavity, said cavity being adapted for receiving a distal end of the digit of the user such that said sleeve covers the distal end of the digit, said sleeve having an upper portion and a lower portion, said upper portion being adapted for covering a top of the distal end of the digit, said lower portion being adapted for covering a digital pulp of the digit of the user;

a plurality of ridges outwardly extending from said lower portion of said sleeve, said ridges increasing a surface area of said lower portion of said sleeve such that said ridges are adapted for increasing engageable surface area between said sleeve and the game controller; and said lower portion of said sleeve having an interior wall and an exterior wall, said interior wall and said exterior wall defining an interior space, an exterior surface of said exterior wall of said lower portion being aligned with an exterior surface of said upper portion, a padding being disposed in said interior space of said lower portion of said sleeve, said padding comprising an impact absorbing material such that said impact absorbing material is adapted for absorbing pressure between the digital pulp of the digit and the game controller when said sleeve is covering the distal end of the digit.

2. The digit covering as set forth in claim 1, wherein said upper portion of said sleeve has a plurality of vent holes extending through said upper portion of said sleeve, each of said vent holes being adapted for allowing air to flow to the distil end of the digit to facilitate evaporation of perspiration from the digit of the user when said sleeve is positioned on the digit.

3. The digit covering as set forth in claim 1, wherein said lower portion of said sleeve has a plurality of drying apertures extending through said lower portion of said sleeve, each of said drying apertures being adapted for allowing air to flow to the distal end of the digit to facilitate evaporation of perspiration from the digit of the user when said sleeve is positioned on the digit.

4. The digit covering as set forth in claim 1, wherein said sleeve comprises an elastomeric material such that said elastomeric material is adapted for stretching to fit said sleeve snuggly on the distal end of the digit.

5. A digit covering for protecting a digit of a user when using a game controller, the digit covering comprising:

a sleeve having a cavity, said cavity being adapted for receiving a distal end of the digit of the user such that said sleeve covers the distal end of the digit, said sleeve having an upper portion and a lower portion, said upper portion being adapted for covering a top of the distal end of the digit, said lower portion being adapted for covering a digital pulp of the digit of the user;

a plurality of ridges outwardly extending from said lower portion of said sleeve, said ridges increasing a surface area of said lower portion of said sleeve such that said ridges are adapted for increasing engageable surface area between said sleeve and the game controller;

said upper portion of said sleeve having a plurality of vent holes extending through said upper portion of said sleeve, each of said vent holes being adapted for allowing air to flow to the distal end of the of the digit to facilitate evaporation of perspiration from the digit of the user when said sleeve in positioned on the digit;

said lower portion of said sleeve having a plurality of drying apertures extending through said lower portion of said sleeve, each of said drying apertures being adapted for allowing air to flow to the distil end of the of the digit to facilitate evaporation of perspiration from the digit of the user when said sleeve in positioned on the digit;

said lower portion of said sleeve having an interior wall and an exterior wall, said interior wall and said exterior wall defining an interior space, an exterior surface of said exterior wall of said lower portion being aligned with an exterior surface of said upper portion, a padding being disposed in said interior space of said lower portion of said sleeve, said padding comprising an impact absorbing material such that said impact absorbing material is adapted for absorbing pressure between the digital pulp of the digit and the game controller when said sleeve is covering the distal end of the digit; and said sleeve comprising an elastomeric material such that said elastomeric material is adapted for stretching to fit said sleeve snuggly on the distal end of the digit.

* * * * *